US011142372B2

(12) United States Patent
Ho

(10) Patent No.: US 11,142,372 B2
(45) Date of Patent: Oct. 12, 2021

(54) TELESCOPIC CONTAINER

(71) Applicant: BOTTO DESIGN LIMITED, Hong Kong (CN)

(72) Inventor: Sui Ling Ho, Hong Kong (CN)

(73) Assignee: BOTTO DESIGN LIMITED, Hong Kong (CN)

( * ) Notice: Subject to any disclaimer, the term of this patent is extended or adjusted under 35 U.S.C. 154(b) by 455 days.

(21) Appl. No.: 16/029,438

(22) Filed: Jul. 6, 2018

(65) Prior Publication Data

US 2019/0031398 A1 Jan. 31, 2019

(30) Foreign Application Priority Data

Jul. 28, 2017 (CN) ..... 201720938738.1

(51) Int. Cl.
*B65D 21/08* (2006.01)
*B65D 51/16* (2006.01)
*B65D 43/02* (2006.01)

(52) U.S. Cl.
CPC ..... *B65D 21/086* (2013.01); *B65D 43/0231* (2013.01); *B65D 51/1644* (2013.01); *B65D 51/1672* (2013.01); *B65D 2543/00092* (2013.01)

(58) Field of Classification Search
CPC ..... B65D 21/086; B65D 43/0231; B65D 51/1605; B65D 51/1611; B65D 51/1644; B65D 51/16; B65D 51/1672; B65D 79/0087; B65D 51/1683
USPC ..... 220/8, 203.01, 203.28, 203.29; 215/260, 215/311
See application file for complete search history.

(56) References Cited

U.S. PATENT DOCUMENTS 1,920,068 A * 7/1933 Elian, Jr. ..... B65D 51/1644 215/311
2,438,434 A * 3/1948 Friedman ..... B65D 77/245 220/8
4,828,129 A * 5/1989 Jonkers ..... B65D 51/1644 215/260
6,026,685 A * 2/2000 Weterrings ..... G01F 19/00 220/8
6,776,301 B2 * 8/2004 Torres-White ..... B65D 51/1644 215/311
7,909,192 B2 * 3/2011 Dempsey ..... B65D 79/005 220/203.03
2010/0308042 A1 * 12/2010 Faris ..... B65D 51/1644 220/8

(Continued)

*Primary Examiner* — James N Smalley
*Assistant Examiner* — Jennifer Castriotta
(74) *Attorney, Agent, or Firm* — Global IP Services; Tianhua Gu

(57) ABSTRACT

A telescopic container comprises an upper part of the container, a lower part of the container and a top cover, the upper part of the container is sleeved on a periphery of the lower part of the container, and the lower part of the container can move in the upper part of the container; and the top cover is detachably connected to a top end of the upper part of the container and is provided with an air valve. A telescoping property between the lower part of the container and the upper part of the container is used in the invention, a user downwardly presses the upper part of the container, or upwardly presses the lower part of the container, or performs the two actions at the same time, so as to achieve an object of changing a capacity of the container.

8 Claims, 6 Drawing Sheets

(56) References Cited

U.S. PATENT DOCUMENTS

| | | | | |
|---|---|---|---|---|
| 2015/0136786 | A1* | 5/2015 | Lonner | B65D 21/086<br>220/529 |
| 2017/0152074 | A1* | 6/2017 | Park | B65D 21/0219 |

* cited by examiner

TELESCOPIC CONTAINER

TECHNICAL FIELD

The invention relates to the field of container for containing objects, and more particularly, to a telescopic container.

BACKGROUND

Most of the storage containers on the market today have a sealing function, but only a few of them can change the capacity of the container at the same time. When the storage container is not completely full, the unused container space can occupy partial storage space, which is inconvenient for storage and carrying of the container. In general, a vacuum container or a container capable of discharging the internal air thereof needs to use electric equipment (such as an electric pump) or a manual pump with a complicated structure to achieve the object thereof, and this type of container is not convenient in practical use.

SUMMARY

In order to overcome the problem above, the invention provides a telescopic container.

The invention provides a telescopic container, which comprises an upper part of the container, a lower part of the container and a top cover, the upper part of the container is sleeved on a periphery of the lower part of the container, and the lower part of the container can move in the upper part of the container; and the top cover is detachably connected to a top end of the upper part of the container and is provided with an air valve.

As a preferred solution of the invention, the top cover comprises an upper part of the top cover detachably connected to the top end of the upper part of the container and a bottom support of the top cover, the bottom support of the top cover is installed in a bottom in the upper part of the top cover and is located inside the upper part of the container, the upper part of the top cover has a first air vent, the bottom support of the top cover has a second air vent, and the air valve is arranged between the first air vent and the second air vent.

As a preferred solution of the invention, a periphery of the first air vent has an annular bulge, and the air valve is arranged in a center of the annular bulge; and a plurality of locking members are arranged on a periphery of a bottom of the annular bulge, a plurality of locking chutes are arranged in an annular shape on a periphery of the second air vent, the locking member is installed in the locking chute, and a closed exhaust passage is formed between the annular bulge and the bottom support of the top cover.

As a preferred solution of the invention, the bottom of the upper part of the top cover has a first annular groove, and the first annular groove is internally provided with a first sealing ring.

As a preferred solution of the invention, a top portion of the upper part of the top cover has a concave recession, and the recession is matched with a bottom end of the lower part of the container.

As a preferred solution of the invention, a bottom end of the lower part of the container is provided with a groove.

As a preferred solution of invention, a first convex ring and a second convex ring are sequentially arranged on a periphery of a top end of the lower part of the container from top to bottom, when the top end of the lower part of the container is located at the bottom end of the upper part of the container, the second convex ring abuts against an inner wall of the upper part of the container, and a second annular groove is formed between the first convex ring and the second convex ring.

As a preferred solution of the invention, the bottom end of the upper part of the container is provided with an annular hook facing towards an inside of the upper part of the container, and when the top end of the lower part of the container is located at the bottom end of the upper part of the container, the annular hook abuts against the second convex ring.

As a preferred solution of the invention, the top end of the lower part of the container is provided with a second sealing ring, the second sealing ring comprises a lower part and an inclined part formed on an upper end of the lower part, a lower end of the lower part abuts against the second convex ring, an inner wall of the lower part is provided with a bulge and a recession respectively matched with the second annular groove and the first convex ring, and the inclined part tightly abuts against the inner wall of the upper part of the container.

As a preferred solution of the invention, an external thread is arranged on a periphery of the top end of the upper part of the container, an inner wall of the upper part of the top cover is provided with an internal thread matched with the external thread, and the upper part of the top cover is in threaded connection with the top end of the upper part of the container.

A telescoping property between the lower part of the container and the upper part of the container is used in the invention, a user downwardly presses the upper part of the container, or upwardly presses the lower part of the container, or performs the two actions at the same time, so as to achieve an object of changing a capacity of the container, which solves the problem that the container occupies extra space when the container is not fully used, and makes better use of storage space. Meanwhile, the air valve in the top cover is used to discharge extra air in the container, which extends a refreshing time of contents of the container (such as food) to a certain extent.

DETAILED DESCRIPTION OF THE EMBODIMENTS

The invention will be further described hereinafter with reference to the accompanying drawings and embodiments.

Figure 1:
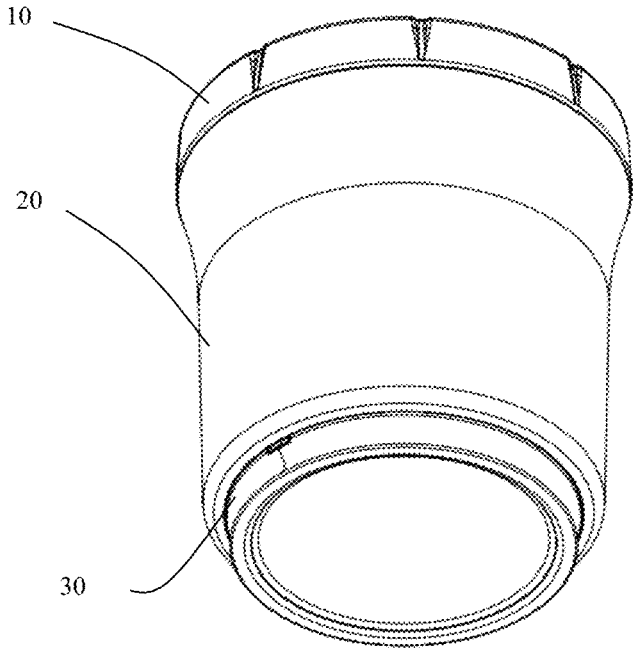
FIG. 1 is a structural schematic diagram illustrating a structure of a telescopic container provided by an embodiment of the invention.
Figure 2:
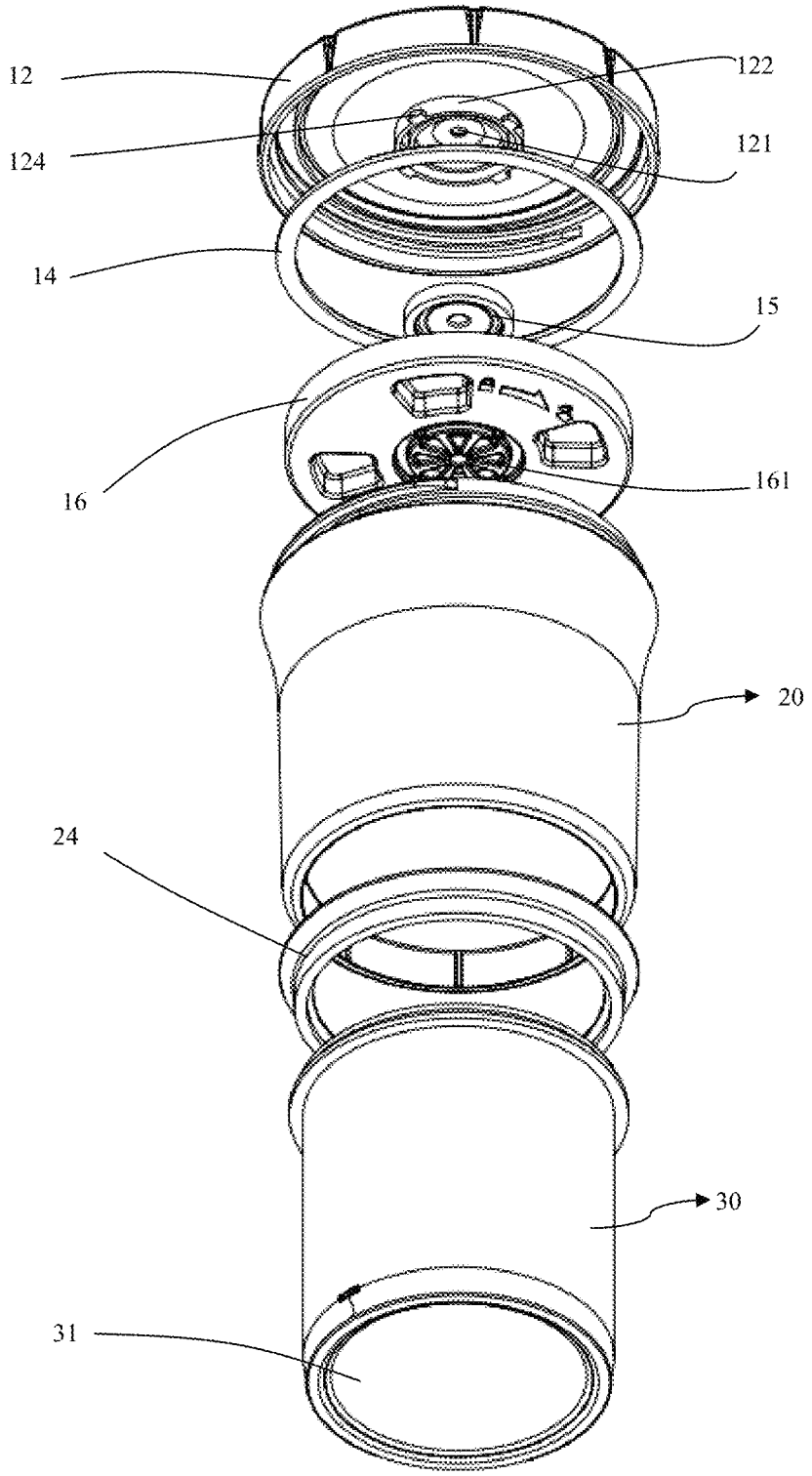
FIG. 2 is an exploded schematic diagram illustrating a structure in a first viewing angle of the telescopic container shown in FIG. 1.
Figure 3:
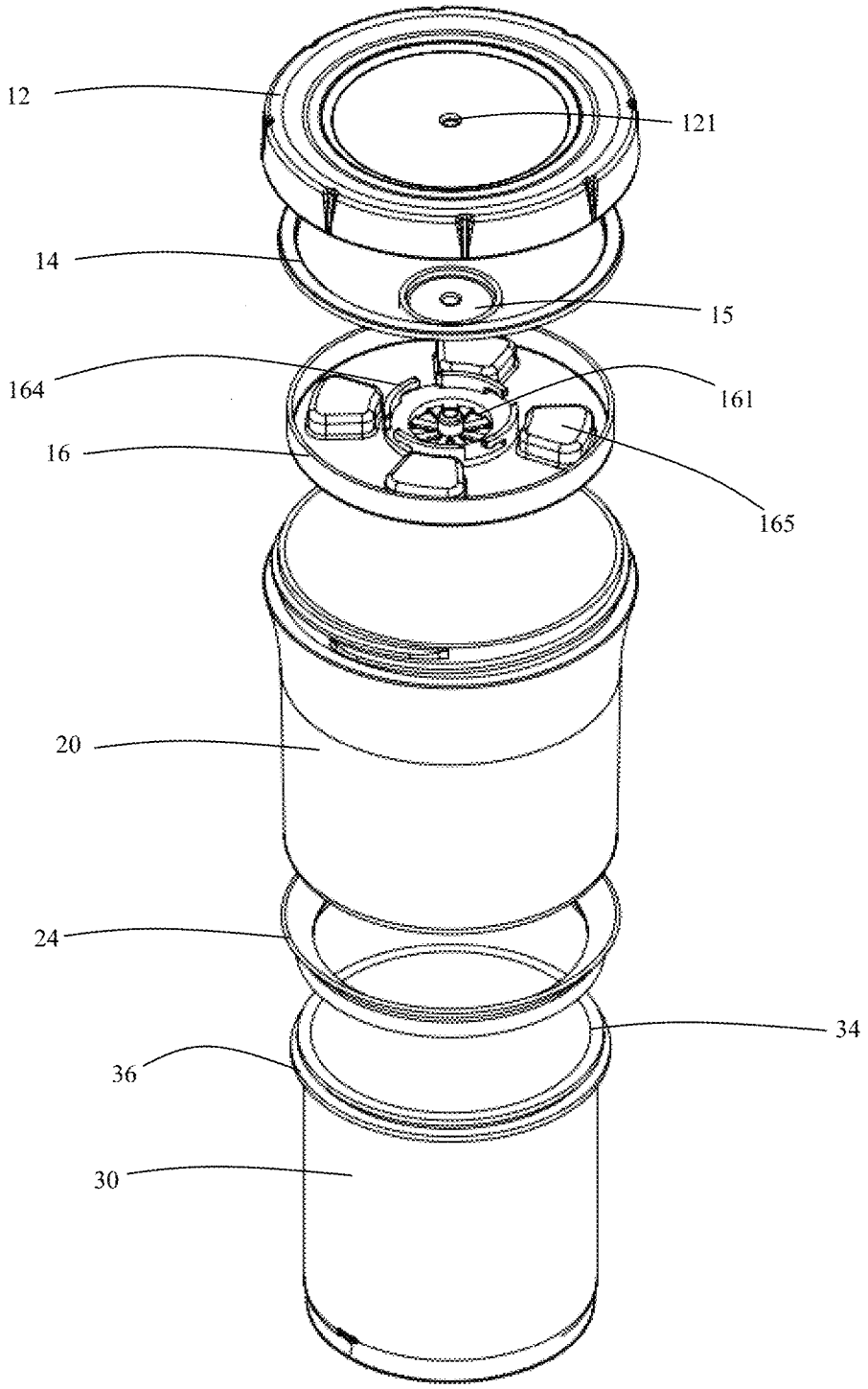
FIG. 3 is an exploded schematic diagram illustrating a structure in a second viewing angle of the telescopic container shown in FIG. 1.

Referring to FIG. 1, FIG. 2 and FIG. 3, the embodiment provides a telescopic container, which comprises an upper part of the container 20, a lower part of the container 30 and a top cover 10, the upper part of the container 20 is sleeved on a periphery of the lower part of the container 30, and the lower part of the container 30 can move in the upper part of the container 20; and the top cover 10 is detachably connected to a top end of the upper part of the container 20. More specifically, the upper part of the container 20 is a hollow cylindrical structure, an external thread is arranged on a periphery of the top end of the upper part of the container and the bottom end of the upper part of the container is provided with an annular hook 26 facing towards an inside of the upper part of the container 20. An inner diameter of the upper part of the container 20 is unchanged, and at the position close to the top portion of upper part of the container 20, a wall of container thereof is gradually thickened towards the top portion of the upper part of the container 20, so that the outer wall of the upper part of the container 20 forms an inclined structure that is convenient for the user to hold by hands.

The lower part of the container 30 is a cylindrical structure having a bottom, and a diameter thereof is slightly smaller than a diameter of the upper part of the container 20. A first convex ring 34 and a second convex ring 36 are sequentially arranged on a periphery of a top end of the lower part of the container 30 from top to bottom, and a second annular groove is formed between the first convex ring 34 and the second convex ring 36. The top end of the lower part of the container 30 is provided with a second sealing ring 24, the second sealing ring 24 comprises a lower part and an inclined part formed on an upper end of the lower part, a lower end of the lower part abuts against the second convex ring 36, an inner wall of the lower part is provided with a bulge and a recession respectively matched with the second annular groove and the first convex ring 34, and the inclined part of the second sealing ring 24 tightly abuts against the inner wall of the upper part of the container 20. The second sealing ring 24 enhances the leak tightness of the container, thus preventing the contents of the container (such as liquid) from flowing into a gap between the upper part of the container 20 and the lower part of the container 30, and even flowing outside the container.

Figure 4:
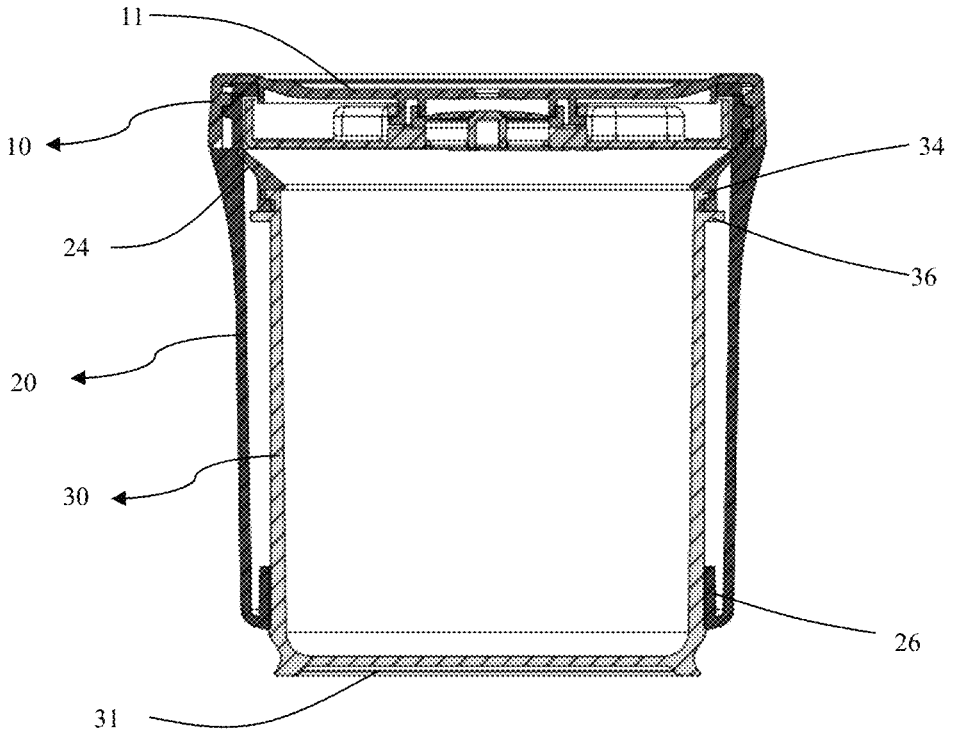
FIG. 4 is a front cross-sectional view of the telescopic container shown in FIG. 1.

As shown in FIG. 4, when the upper part of the container 20 is completely sleeved on the periphery of the lower part of the container 30, the container has a minimum capacity value. A center of a bottom end of the lower part of the container 30 is provided with a groove 31, the user can insert a finger into the groove 31 and exert force on the outside of the lower part of the container 30 to draw out lower part of the container 30 from the bottom end of the upper part of the container 20, or draw out the upper part of the container 20 from the top end of the lower part of the container 30, or both of which are performed simultaneously.

As the upper part of the container 20 gradually keeps away from the lower part of the container 30, the capacity value of the container is increased. In this process, the annular hook 26 is located in the gap between the upper part of the container 20 and the lower part of the container 30, and closely abuts against the outer wall of the lower part of the container 30.

Figure 5:
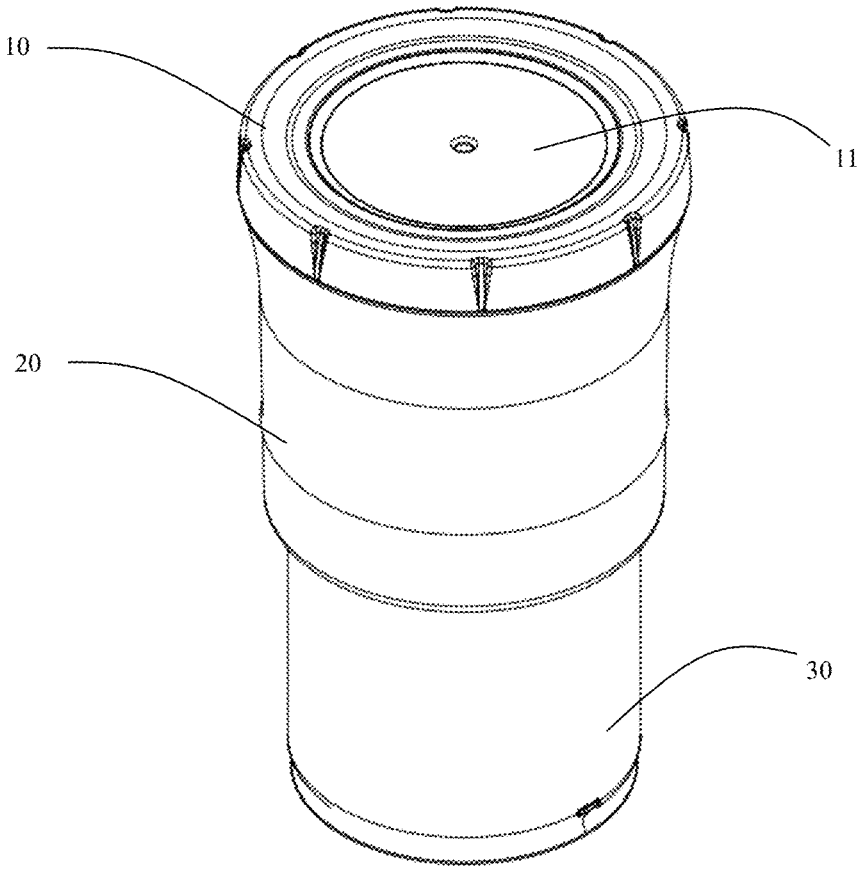
FIG. 5 is a schematic diagram illustrating a structure of the telescopic container in stretching shown in FIG. 1.
Figure 6:
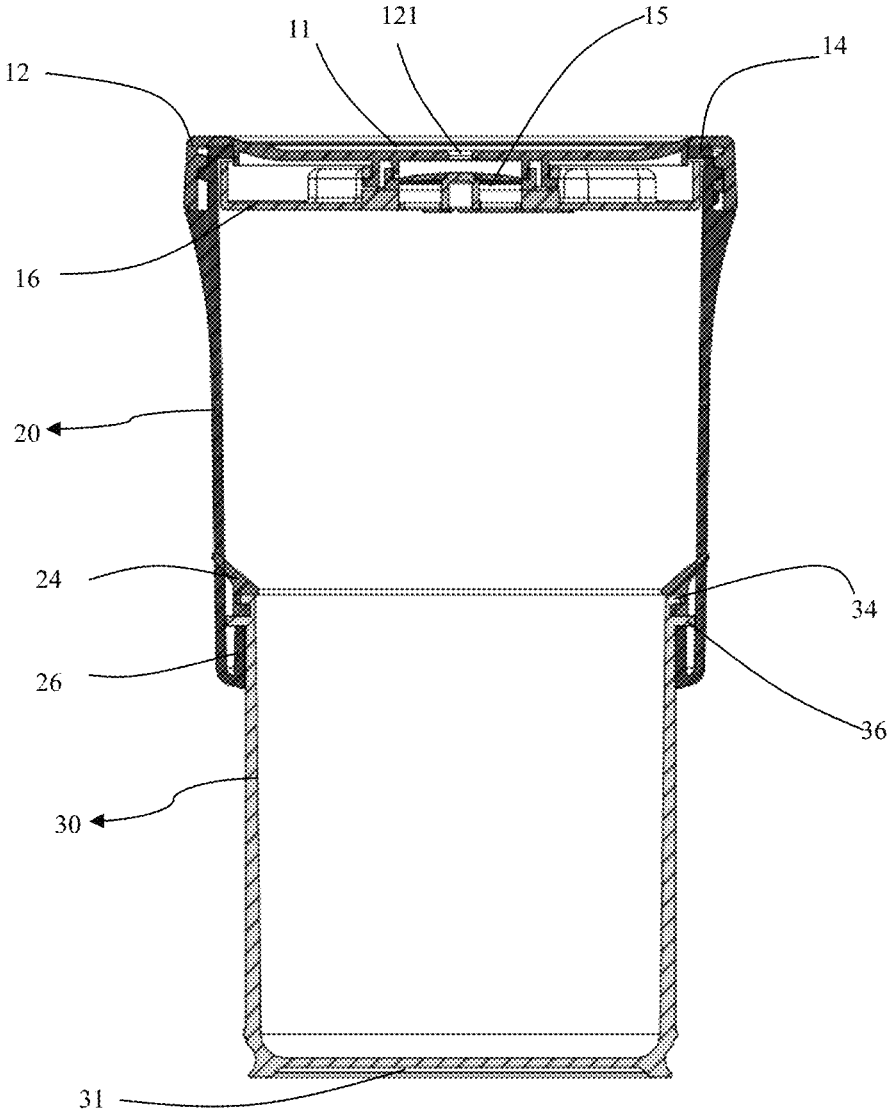
FIG. 6 is a front cross-sectional view of the telescopic container shown in FIG. 5.

As shown in FIG. 5 and FIG. 6, when the top end of the lower part of the container 30 is located at the bottom end of the upper part of the container 20, the capacity value of the container is also increased to the maximum. At the moment, the annular hook 26 of the upper part of the container 20 abuts against the second convex ring 36 of the lower part of the container 30 to prevent the upper part of the container 20 from further keeping away from the lower part of the container 30.

The top cover 10 in this embodiment comprises an upper part of the top cover 12 detachably connected to the top end of the upper part of the container and a bottom support of the top cover 16, and the bottom support of the top cover 16 is installed in a bottom in the upper part of the top cover 12 and is located inside the upper part of the container. An inner wall of the upper part of the top cover 12 is provided with an internal thread matched with the external thread at the top end of the upper part of the container 20, so that the upper part of the top cover 12 is in threaded connection with the top end of the upper part of the container 20.

A top portion of the upper part of the top cover 12 has a concave recession 11, and the recession 11 is matched with a bottom end of the lower part of the container 30. The recession 11 enhances the stability of stacking a plurality of containers for containing. Through containing the containers by stacking, the area occupied by the containers can be effectively reduced. A plurality of dents are arranged on the periphery of the upper part of the top cover 12 for enhancing a frictional force between user's hands and the top cover 10, which facilitates the user to tighten the top cover 10 on the container.

The bottom of the upper part of the top cover 12 has a first annular groove, and the first annular groove is internally provided with a first sealing ring 14, which is used to prevent the contents of the container (such as liquid) from leaking outside the container from the gap between the upper part of the top cover 12 and upper part of the container 20.

An air valve 15 is also arranged in the top cover 10. More specifically, the upper part of the top cover 12 in this embodiment has a first air vent 121, the bottom support of the top cover 16 has a second air vent 161, and the air valve 15 is arranged between the first air vent 121 and the second air vent 161. A periphery of the first air vent 121 has an annular bulge 122, and a plurality of locking members 124 are arranged on a periphery of a bottom of the annular bulge 122. A plurality of locking chutes 164 are arranged in an annular shape on a periphery of the second air vent 161, the locking member 124 is installed in the locking chute 164, a closed exhaust passage is formed between the annular bulge 122 and the bottom support of the top cover 16, and the air valve is arranged in the exhaust passage.

A user downwardly presses the upper part of the container 20, or upwardly presses the lower part of the container 30, or performs the two actions at the same time, the air in the container can enter the exhaust passage from the second air vent 161 of the bottom support of the top cover 16, and then the air is discharged outside the container from the first air vent 121 of the upper part of the top cover 12 after passing through the air valve 15. The air valve can reduce the pressure of the air on the top cover 10 and prevent the air from pushing the top cover 10 out of the upper part of the container 20. On the other hand, by reducing the air in the container, the contents of the container can be prevented from being affected with damp to a certain extent, the contents of the container are prevented from deteriorating, and the refreshing time of the contents of the container is prolonged.

A plurality of bumps 165 are also arranged on a bottom surface in the bottom support of the top cover 16. The bumps 165 are distributed around the locking member 124. When the upper part of the container 20 is pressed against the lower part of the container 30, or the lower part of the container 30 is pushed towards the upper part of the container 20, the air pressure in the container born by the bottom support of the top cover 16 is large, and the bumps 165 can relieve the pressure and reduce the air pressure born by the bottom support of the top cover 16. Meanwhile, a plurality of bumps 165 being arranged on the bottom surface of the bottom support of the top cover 16 facilitates the user's hands to rotate the bottom support of the top cover 16 through the bumps 165, so as to disassemble the bottom support of the top cover 16 from the top cover 10.

According to the telescopic container provided by the invention, the top cover 10, the upper part of the container 20, and the lower part of the container 30 can be respectively disassembled without any additional tools to facilitate the cleaning, and can be assembled and reused after cleaning, thereby being hygienic and environmental protection.

A telescoping property between the lower part of the container and the upper part of the container is used in the invention, a user downwardly presses the upper part of the container, or upwardly presses the lower part of the container, or performs the two actions at the same time, so as to achieve an object of reducing a capacity of the container, which solves the problem that the container occupies extra space when the container is not fully used, and makes better use of storage space. When the user needs to increase the capacity of the container, the user only needs to pull up the upper part of the container, or pull down the lower part of the container, or performs the two actions at the same time, so as to achieve an object of increasing the capacity of the container. The air valve in the top cover is used to discharge extra air in the container, which can further extend a refreshing time of contents of the container (such as food) to a certain extent.

Those ordinary skilled in the art can further make several deformations and improvements without departing from the conception of the invention, and these deformations and improvements all fall in the protection scope of the invention. Therefore, the protection scope of the patent for invention shall be subject to the appended claims.

What is claimed is:

1. A telescopic container comprising:

an upper part of the container (20), a lower part of the container (30) and a top cover (10), the upper part of the container (20) is sleeved on a periphery of the lower part of the container, the lower part of the container can move in the upper part of the container, and the top cover is detachably connected to a top end of the upper part of the container and is provided with an air valve (15);

the top cover (10) comprises an upper part of the top cover (12) detachably connected to the top end of the upper part of the container and a bottom support of the top cover (16), the bottom support of the top cover (16) is installed in a bottom in the upper part of the top cover (12) and is located inside the upper part of the container, the upper part of the top cover (12) has a first air vent (121), the bottom support of the top cover (16) has a second air vent (161), and the air valve (15) is arranged between the first air vent (121) and the second air vent (161);

a periphery of the first air vent (121) has an annular bulge (122), and the air valve (15) is arranged in a center of the annular bulge (122), a plurality of locking members (124) are arranged on a periphery of a bottom of the annular bulge (122), a plurality of locking chutes (164) are arranged in an annular shape on a periphery of the second air vent (161), the locking member is installed in the locking chute, and a closed exhaust passage is formed between the annular bulge (122) and the bottom support of the top cover (16).

2. The container according to claim 1, wherein the bottom of the upper part of the top cover (12) has a first annular groove, and the first annular groove is internally provided with a first sealing ring (14).

3. The container according to claim 2, wherein a first convex ring (34) and a second convex ring (36) are sequentially arranged on a periphery of a top end of the lower part of the container (30) from top to bottom, when the top end of the lower part of the container is located at the bottom end of the upper part of the container, the second convex ring (36) abuts against an inner wall of the upper part of the container, and a second annular groove is formed between the first convex ring (34) and the second convex ring (36).

4. The container according to claim 3, wherein the bottom end of the upper part of the container (20) is provided with an annular hook (26) facing towards an inside of the upper part of the container (20), and when the top end of the lower part of the container is located at the bottom end of the upper part of the container, the annular hook (26) abuts against the second convex ring (36).

5. The container according to claim 3, wherein the top end of the lower part of the container (30) is provided with a second sealing ring (24), the second sealing ring (24) comprises a lower part and an inclined part formed on an upper end of the lower part, a lower end of the lower part abuts against the second convex ring (36), an inner wall of the lower part is provided with a bulge and a recession respectively matched with the second annular groove and the first convex ring, and the inclined part tightly abuts against the inner wall of the upper part of the container (20).

6. The container according to claim 1, wherein a top portion of the upper part of the top cover (12) has a concave recession (11), and the recession is matched with a bottom end of the lower part of the container (30).

7. The container according to claim 1, wherein a bottom end of the lower part of the container (30) is provided with a groove (31).

8. The container according to claim 1, wherein an external thread is arranged on a periphery of the top end of the upper part of the container (20), an inner wall of the upper part of the top cover (12) is provided with an internal thread matched with the external thread, and the upper part of the top cover (12) is in threaded connection with the top end of the upper part of the container (20).

* * * * *